US010400426B2

(12) United States Patent
Yamashita et al.

(10) Patent No.: US 10,400,426 B2
(45) Date of Patent: Sep. 3, 2019

(54) HYDRAULIC CONTROL SYSTEM FOR CONSTRUCTION MACHINE

(71) Applicant: HITACHI CONSTRUCTION MACHINERY CO., LTD., Tokyo (JP)

(72) Inventors: Ryohei Yamashita, Tsuchiura (JP); Shinya Imura, Toride (JP); Kouji Ishikawa, Kasumigaura (JP); Hidekazu Moriki, Mito (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 250 days.

(21) Appl. No.: 15/506,863

(22) PCT Filed: Sep. 4, 2015

(86) PCT No.: PCT/JP2015/075269
§ 371 (c)(1),
(2) Date: Feb. 27, 2017

(87) PCT Pub. No.: WO2016/056334
PCT Pub. Date: Apr. 14, 2016

(65) Prior Publication Data

US 2017/0275852 A1 Sep. 28, 2017

(30) Foreign Application Priority Data

Oct. 7, 2014 (JP) ..... 2014-206451

(51) Int. Cl.
*E02F 9/22* (2006.01)
*F15B 11/028* (2006.01)
(Continued)

(52) U.S. Cl.
CPC ..... *E02F 9/22* (2013.01); *F15B 11/028* (2013.01); *F15B 11/04* (2013.01); *F15B 11/044* (2013.01);
(Continued)

(58) Field of Classification Search
CPC . F15B 11/028; F15B 11/044; F15B 2211/761; F15B 2211/46; F15B 2211/353
See application file for complete search history.

(56) References Cited

U.S. PATENT DOCUMENTS

2010/0132349 A1 6/2010 Brahmer
2012/0031088 A1* 2/2012 Takebayashi ..... E02F 9/2225 60/452

FOREIGN PATENT DOCUMENTS

JP 02-142902 A 6/1990
JP 2004-076904 A 3/2004
(Continued)

OTHER PUBLICATIONS

JP 2010014244 A machine translation to English from espacenet. 2010.*
(Continued)

*Primary Examiner* — Thomas E Lazo
*Assistant Examiner* — Michael Quandt
(74) *Attorney, Agent, or Firm* — Mattingly & Malur, PC

(57) ABSTRACT

Provided is a hydraulic control system for a construction machine, including: a control valve (31) for controlling supply and discharge of hydraulic fluid to and from an arm cylinder (4); an operation lever (6) for controlling the position of a spool of the control valve (31); a meter-out flow passage (34) for passing therethrough hydraulic fluid discharged from the arm cylinder; a variable restrictor (23*a*) provided in the meter-out flow passage; pressure sensors (41, 42) for detecting a magnitude of a negative load applied by an external force to the arm cylinder in a same direction as an actuation direction of the arm cylinder; and a controller (45) for reducing an opening area of the variable restrictor
(Continued)

(23*a*) according to an increase in the magnitude of the negative load calculated with a detection value from the pressure sensors (41, 42).

4 Claims, 11 Drawing Sheets

(51) Int. Cl.
*F15B 11/044* (2006.01)
*F15B 11/08* (2006.01)
*F15B 11/04* (2006.01)

(52) U.S. Cl.
CPC ..... *F15B 11/08* (2013.01); *F15B 2211/353* (2013.01); *F15B 2211/40515* (2013.01); *F15B 2211/41581* (2013.01); *F15B 2211/46* (2013.01); *F15B 2211/6313* (2013.01); *F15B 2211/6346* (2013.01); *F15B 2211/665* (2013.01); *F15B 2211/7053* (2013.01); *F15B 2211/761* (2013.01)

(56) References Cited

FOREIGN PATENT DOCUMENTS

| | | | | |
|---|---|---|---|---|
| JP | 2004-225805 | A | | 8/2004 |
| JP | 2006-177402 | A | | 7/2006 |
| JP | 2010014244 | A | * | 1/2010 |

OTHER PUBLICATIONS

International Preliminary Report on Patentability received in corresponding International Application No. PCT/JP2015/075269 dated Apr. 20, 2017.

International Search Report of PCT/JP2015/075269 dated Jan. 24, 2015.

* cited by examiner

HYDRAULIC CONTROL SYSTEM FOR CONSTRUCTION MACHINE

TECHNICAL FIELD

The present invention relates to a hydraulic control system for a construction machine which is provided with a hydraulic actuator.

BACKGROUND ART

Construction machines such as hydraulic excavators or the like are generally provided with a hydraulic pump, hydraulic actuators which are driven by hydraulic fluid delivered from the hydraulic pump, and flow control valves for controlling supply and discharge hydraulic fluid supplied to and from the hydraulic actuators. In case of a hydraulic excavator, for example, the hydraulic actuators include a boom cylinder for driving the boom of a front work implement, an arm cylinder for driving an arm, a bucket cylinder for driving a bucket, a swing hydraulic motor for swinging a swing structure, and a travel hydraulic motor for travelling a track structure. These actuators are combined with respective flow control valves. Each of the flow control valves has a meter-in restrictor and a meter-out restrictor. The meter-in restrictor controls the flow rate of hydraulic fluid supplied from the hydraulic pump to the corresponding hydraulic actuator, whereas the meter-out restrictor controls the flow rate of hydraulic fluid discharged from the hydraulic actuator to a tank.

On a construction machine equipped with such hydraulic actuators, the self-weight of an object supported by a hydraulic actuator (e.g., if the hydraulic actuator is an arm cylinder, then the arm or bucket (attachment) is a main object supported thereby) acts as a load, which may hereinafter be referred to as "negative load," applied in the same direction as the actuation direction of the hydraulic actuator, tending to increase the actuation speed of the hydraulic actuator and hence causing a shortage of hydraulic fluid on the meter-in side thereby to bring about a breathing phenomenon (cavitation), which is likely to make the construction machine less controllable.

In respect of the above problem, the invention of Patent Document 1 discloses a circuit in which a pilot variable opening valve is inserted in a meter-out line branched off from the rod-side line of a hydraulic cylinder and connected to a tank such that the pilot variable opening valve is controlled to increase or reduce the opening thereof. In the circuit, when the actuation speed of an arm cylinder tends to increase due to the self-weight of an arm and a bucket which are heavy loads on the arm cylinder (tends to drop under self-weight), the opening of the pilot variable opening valve is restricted to prevent the holding pressure in the rod-side hydraulic chamber from decreasing, thereby preventing the arm cylinder from dropping under self-weight.

PRIOR ART DOCUMENT

Patent Document

Patent Document 1: JP-2006-177402-A

SUMMARY OF THE INVENTION

Problem to be Solved by the Invention

The weight of an object supported by a hydraulic actuator on a construction machine is often liable to change. For example, the weight may change when an attachment (working tool) mounted on the distal end of a front working implement (the distal end of an arm) of a hydraulic excavator is replaced with another attachment. The hydraulic excavator uses a variety of attachments, other than a standard bucket, having different weights, e.g., a large-size bucket, a crusher, a splitter, and many of the attachments are heavier than the standard bucket. Upon development of a hydraulic excavator, the opening area of a meter-out restrictor of an arm cylinder is adjusted on the assumption that a standard bucket is mounted thereon. If, another heavier attachment, instead of the standard bucket, is mounted on the arm cylinder by the user, then when the arm of the front work implement is crowded above the ground (i.e., aerially), since the total weight of the arm and the attachment is greater than if the standard bucket is mounted on the arm cylinder, the speed of the arm cylinder becomes higher than if the standard bucket is mounted on the arm cylinder, thus causing a shortage of hydraulic fluid on the meter-in side thereby to bring about a breathing phenomenon (cavitation), which is likely to make the construction machine less controllable.

One solution to the above problem is considered to assume that a heavier attachment than the standard bucket is mounted on the arm cylinder and to adjust the properties of the opening area of the meter-out restrictor of the arm cylinder to values smaller than the optimum properties used for the standard bucket. However, when the standard bucket is installed on the hydraulic excavator thus adjusted and the arm crowding operation is performed, an energy loss occurs because a higher pressure loss is caused than a meter-out pressure loss (pressure loss at the optimum values) that is required to generate a force resisting the weight load of the standard bucket and the arm.

Furthermore, the rod-side pressure (meter-out pressure loss) of the arm cylinder which is required to prevent the rate of extension of the arm cylinder from increasing and to prevent a breathing phenomenon from being developed (these phenomena will hereinafter referred to as "breathing phenomenon, etc.") varies depending on not only the weight of an attachment used, but also the angle (attitude) of the arm supported by the arm cylinder with respect to the horizontal plane. For example, it is assumed that the arm cylinder is extended from the state in which the arm is kept substantially horizontally in the air by the arm cylinder (the angle of the arm at this time is assumed to be zero), crowding the arm about the rotating shaft on the distal end of the boom toward the main body side of the hydraulic excavator. Immediately after the arm cylinder starts to be extended, since the negative load imposed on the arm cylinder by the self-weight of the arm, etc. is relatively large, it is necessary to increase the rod-side pressure to prevent a breathing phenomenon, etc. from occurring. However, when the arm cylinder is further extended until the arm is oriented nearly vertically, since most of the weight of the arm is supported by the boom, and the negative load imposed on the arm cylinder by the self-weight of the arm, etc. is relatively small, a breathing phenomenon, etc. is prevented from occurring even if the rod-side pressure is lower than immediately after the arm cylinder starts to be extended.

As described above, on hydraulic excavators, the self-weight of the object (mainly an arm or an attachment) that is supported by the rod of the arm cylinder acts as a negative load on the rod, producing a cylinder thrust in the direction to extend the rod. If the attitude or weight of the supported object (i.e., the attitude of the arm or the weight of the attachment) varies, then the magnitude of the negative load acting on the arm cylinder, i.e., the cylinder thrust in the direction to extend the rod, also varies, resulting in a change in the rod-side pressure required to prevent a breathing phenomenon, etc. from occurring. In other words, even if the opening area of the meter-out restrictor of the arm cylinder is designed on the basis of a certain attitude of a supported object having a certain weight, used as standards, when the weight or attitude of the supported object changes, it deviates from the standards, and the designed opening area fails to minimize an energy loss. This problem happens not only in the arm crowding operation, but also in operations for other hydraulic actuators, e.g., bucket crowding operation by a bucket cylinder and a swinging operation by a swing hydraulic motor.

It is an object of the present invention to provide a hydraulic control system for a construction machine which is provided with a hydraulic actuator, which is capable of reducing a meter-out loss according to a change in a negative load imposed on the hydraulic actuator by an object that is supported by the hydraulic actuator even if the magnitude of the negative load is varied due to a change in the weight and attitude of the supported object.

Means for Solving the Problem

To achieve the above object, there is provided in accordance with the present invention a hydraulic control system for a construction machine, including: a hydraulic actuator driven by hydraulic fluid delivered from a hydraulic pump; a control valve for controlling supply and discharge of hydraulic fluid to and from the hydraulic actuator according to a position of a spool; an operation device for controlling the position of the spool of the control valve according to an operation amount and an operation direction; one or plurality of meter-out flow passages for passing therethrough hydraulic fluid discharged from the hydraulic actuator; at least one variable restrictor provided in the one meter-out flow passage, or at least one variable restrictor provided in each of the plurality of meter-out flow passages; a load sensor for detecting a magnitude of a negative load applied by an external force to the hydraulic actuator in a same direction as an actuation direction of the hydraulic actuator; and a control device for reducing, according to an increase in the magnitude of the negative load detected by the load sensor, the opening area of the one variable restrictor in a case where only one variable restrictor is provided, or a sum of the opening areas of the plurality of variable restrictors in a case where two or more variable restrictors are provided.

Effect of the Invention

According to the present invention, a meter-out loss can be reduced according to a change in the magnitude of the negative load imposed on the hydraulic actuator by an object that is supported by the hydraulic actuator even if the weight and attitude of the supported object is varied.

MODES FOR CARRYING OUT THE INVENTION

Figure 1:
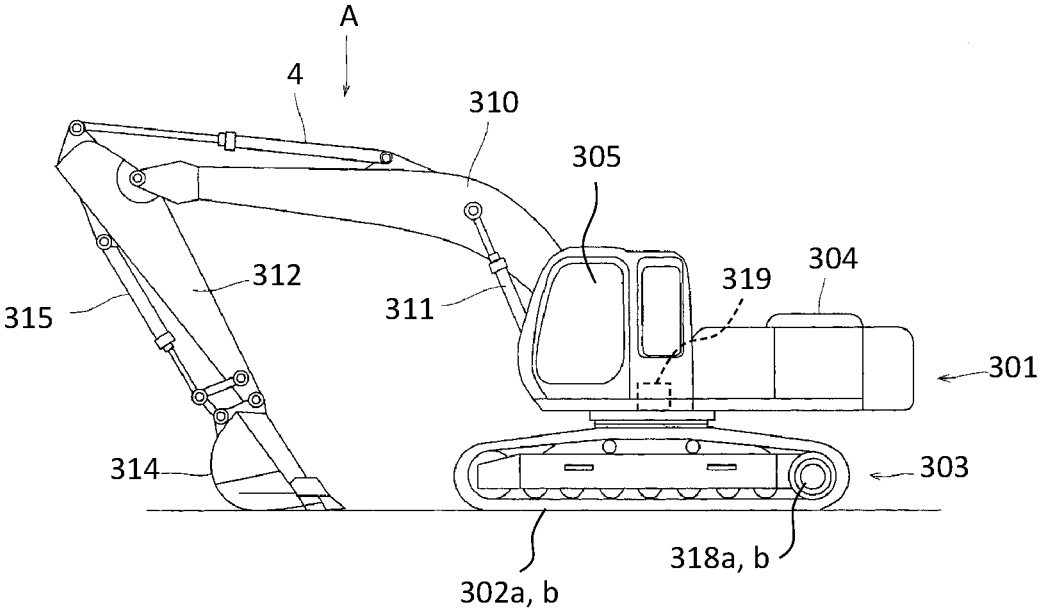
FIG. 1 is a side elevational view of a hydraulic excavator which is common to respective embodiments of the present invention.

Prior to describing embodiments of the present invention, main features of the hydraulic control system for the construction machine according to the embodiments of the present invention will first be described below.

(1) A hydraulic control system for a construction machine (e.g., a hydraulic excavator) according to an embodiment of the present invention, to be described later, includes: a hydraulic actuator driven by hydraulic fluid delivered from a hydraulic pump; a control valve for controlling supply and discharge of hydraulic fluid to and from the hydraulic actuator according to a position of a spool; an operation device for controlling the position of the spool of the control valve according to an operation amount and an operation direction; one or plurality of meter-out flow passages for passing therethrough hydraulic fluid discharged from the hydraulic actuator; at least one variable restrictor provided in the one meter-out flow passage, or at least one variable restrictor provided in each of the plurality of meter-out flow passages; a load sensor for detecting a magnitude of a negative load applied by an external force to the hydraulic actuator in a same direction as an actuation direction of the hydraulic actuator; and a control device for reducing, according to an increase in the magnitude of the negative load detected by the load sensor, the opening area of the one variable restrictor in a case where only one variable restrictor is provided, or a sum of the opening areas of the plurality of variable restrictors in a case where two or more variable restrictors are provided.

In the hydraulic control system thus arranged, the magnitude of the negative load (the load added as a driving force to the hydraulic actuator) applied to the hydraulic actuator by the external force (e.g., the weight of an object supported by the hydraulic actuator) is detected by the load sensor, and the control device controls the opening area of the one meter-out flow passage or the plurality of meter-out flow passages in order to reduce the opening area of the one meter-out flow passage or the sum of the opening areas of the plurality of meter-out flow passages as the magnitude of the negative load detected by the load sensor increases, so that the opening area of the one meter-out flow passage or the sum of the opening areas of the plurality of meter-out flow passages is appropriately set to a value suitable for the magnitude of the negative load. Even if the weight and attitude of the supported object is varied, thereby changing the magnitude of the negative load, the opening area of the one meter-out flow passage or the sum of the opening areas of the plurality of meter-out flow passages is set to a value suitable for preventing a breathing phenomenon, etc. according to the magnitude of the negative load. Therefore, an extra meter-out loss is prevented from being developed, and an energy loss is reduced.

The hydraulic actuator may include a hydraulic cylinder, a hydraulic motor, etc., but typically includes an arm cylinder or a bucket cylinder (both a hydraulic cylinder) of a hydraulic excavator. The arm cylinder includes, as the supported object, for example, an arm and an attachment (e.g., a bucket) mounted on the distal end of the arm. When the arm cylinder is actuated to extend (for arm crowding), the negative load may be varied according to the attitude of the arm and the weight of the attachment. The present invention effectively works in such a case.

A specific example of the load sensor includes two pressure sensors (e.g., pressure sensors 41, 42 to be described later) installed in two flow passages used to supply and discharge hydraulic fluid to and from the hydraulic actuator, for detecting pressure values of hydraulic fluid in the two flow passages. Respective forces acting on hydraulic fluid supplying side and hydraulic fluid discharging side of the hydraulic actuator are calculated on the basis of the two pressure sensors, and the magnitude of the negative load is detected from the difference between the two forces. For example, if the hydraulic actuator is a hydraulic cylinder, then the pressure sensors include a first pressure sensor for detecting the pressure in the bottom-side hydraulic chamber of the hydraulic cylinder and a second pressure sensor for detecting the pressure in the rod-side hydraulic chamber of the hydraulic cylinder, and the magnitude of the negative load can be calculated from the detected values from the two pressure sensors, the pressure bearing area value of the piston in the bottom-side hydraulic chamber, and the pressure bearing area value of the piston in the rod-side hydraulic chamber.

(2) In (1) referred to above, preferably, a range in which the opening area of the one variable restrictor or the sum of the opening areas of the plurality of variable restrictors is varied by the control device according to the increase in the magnitude of the negative load detected by the load sensor has an upper limit value and a lower limit value with respect to each value of the operation amount of the operation device, and the upper limit value and the lower limit value are increased according to the increase in the operation amount of the operation device.

When the upper limit value and the lower limit value are increased according to the increase in the operation amount of the operation device, the opening area of the one meter-out flow passage or the sum of the opening areas of the plurality of meter-out flow passages is adjusted to a value suitable for the operation amount of the operation device. Consequently, the energy loss according to the operation amount of the operation device is reduced.

(3) In (2) referred to above, preferably, "the one meter-out flow passage" is a first flow passage (e.g., an actuator line 34 to be described later) through which hydraulic fluid discharged from the hydraulic actuator flows when the hydraulic actuator is actuated in the same direction as the negative load, the first flow passage passing through the control valve. "The at least one variable restrictor" is a first variable restrictor (e.g., a meter-out restrictor 23*a* to be described later) provided in the control valve in the first flow passage, and "the control device" reduces the opening area of the first variable restrictor by changing the position of the spool of the control valve according to the increase in the magnitude of the negative load detected by the load sensor.

The above arrangement which controls the opening area of the first variable restrictor in the first control valve by changing the position of the spool of the control valve according to the magnitude of the negative load, makes it easy to improve an ordinary construction machine provided with a control valve to accomplish the arrangement of the present invention, and is able to reduce the number of added components, so that the hydraulic control system is prevented from becoming larger in size.

The position of the spool of a control valve in an ordinary construction machine is controlled on the basis of a control signal output according to the operation amount of the control device (in case of a hydraulic excavator, a pilot pressure output to the control valve after being depressurized according to the operation amount of the operation lever). If the arrangement of the present invention is employed, then the control signal in the arrangement may be appropriately corrected according to the magnitude of the negative load. One means available for correcting the control signal is, for example, a proportional pressure reducing valve (e.g., a solenoid proportional pressure reducing valve (a solenoid proportional valve 44 to be described later)) for depressurizing a pilot pressure output from an operation lever according to an increase in the negative load. The proportional pressure reducing valve may be additionally provided in the arrangement to reduce the opening area of the first variable restrictor according to an increase in the negative load.

(4) In (2) referred to above, some arrangements as follows can be adopted: "the plurality of meter-out flow passages" are a first flow passage (e.g., an actuator line 34 to be described later) through which hydraulic fluid discharged from the hydraulic actuator flows when the hydraulic actuator is actuated in the same direction as the negative load, the first flow passage passing through the control valve, and a second flow passage (e.g., a meter-out branch line 51 to be described later) through which hydraulic fluid discharged from the hydraulic actuator flows when the hydraulic actuator is actuated in the same direction as the negative load, the second flow passages being branched from a middle of the first flow passage; "the at least one variable restrictor provided in each of the plurality of meter-out flow passages" may include a first variable restrictor (e.g., a meter-out restrictor 23*a* to be described later) provided in the control valve in the first flow passage and having an opening area that increases according to an increase in the operation amount of the operation device, and a second variable restricting device (e.g., a meter-out restrictor 52*a* to be described later) provided in the second flow passage and having an opening area that increases according to an increase in a pilot pressure output from a hydraulic fluid source; and "the control device" reduces the opening area of the second variable restrictor according to the increase in the magnitude of the negative load detected by the load sensor, and thereby reduces the sum of the opening areas of the first variable restrictor and the second variable restrictor according to the increase in the magnitude of the negative load detected by the load sensor.

With the above arrangement, since it is possible to control the sum of the opening areas of the first variable restrictor and the second variable restrictor, the range in which to control the opening area can be widened compared with the above (3) where the opening area of only the first variable restrictor is controlled. The wider range in which to control the opening area offers a design merit for large-size construction machines in which meter-out flow rates from hydraulic actuators are relatively high.

(5) In (4) referred to above, "the hydraulic fluid source of the pilot pressure for the second variable restricting device" may include the delivery pressure (primary pressure) of a pilot pump or the operation device that allows a pilot pressure (secondary pressure) obtained by depressurizing the delivery pressure of the pilot pump to be output. The former "pilot pump" in particular is capable of achieving a wider control range than the latter control device which uses the secondary pressure from the pilot pump.

Embodiments of the present invention will be described below with reference to the drawings. FIG. 1 is a side elevational view of a hydraulic excavator 301 which is common to the respective embodiments to be described below. The hydraulic excavator 301 has a single multi-joint front work implement A, a track structure 303 provided with a pair of left and right crawlers 302*a*, 302*b*, and a swing structure 304 swingably mounted on the top of the track structure 303.

The track structure 303 supports thereon travel hydraulic motors 318*a*, 318*b* for driving the crawlers 302*a*, 302*b*. A swing hydraulic motor 319 for swinging the swing structure 304 is provided at a central portion in the swing structure 304. A cabin 305 with an operation lever (operation device) 6 (see FIG. 2) provided therein is installed on a front left side of the swing structure 304. The front work implement A is mounted on a front central portion of the swing structure 304.

The front work implement A includes a boom 310 vertically swingably mounted on a boom foot (not shown) on the front central portion of the swing structure 304, an arm 312 swingably mounted on the distal end of the boom 310 for back-and-forth swinging movement, and a bucket 314 vertically rotatably mounted as a working tool (attachment) on the distal end of the arm 312.

The front work implement A also has a boom cylinder (hydraulic cylinder) 311 coupled to the boom foot and the boom 310 for vertically swinging the boom 310, an arm cylinder (hydraulic cylinder) 4 coupled to the boom 310 and the arm 312 for vertically swinging the arm 312, and a bucket cylinder (hydraulic cylinder) 315 coupled to the arm 312 and the working tool 314 for vertically rotating the bucket 314. The front work implement A is driven by these hydraulic cylinders 311, 4, 315.

The term "arm crowding" which will be described later refers to the arm 312 being actuated to rotate counterclockwise in FIG. 1 about the support shaft (rotating shaft) on the boom 310 by extending the arm cylinder 4. The term "bucket crowding" refers to the bucket 314 being actuated to rotate counterclockwise in FIG. 1 about the support shaft on the arm 312 by extending the bucket cylinder 315.

The bucket 314, shown in FIG. 1 as a bucket, can be arbitrarily replaced with one of other attachments including a grapple, a cutter, a breaker, etc. according to the work to be performed by the work machine 301.

Figure 2:
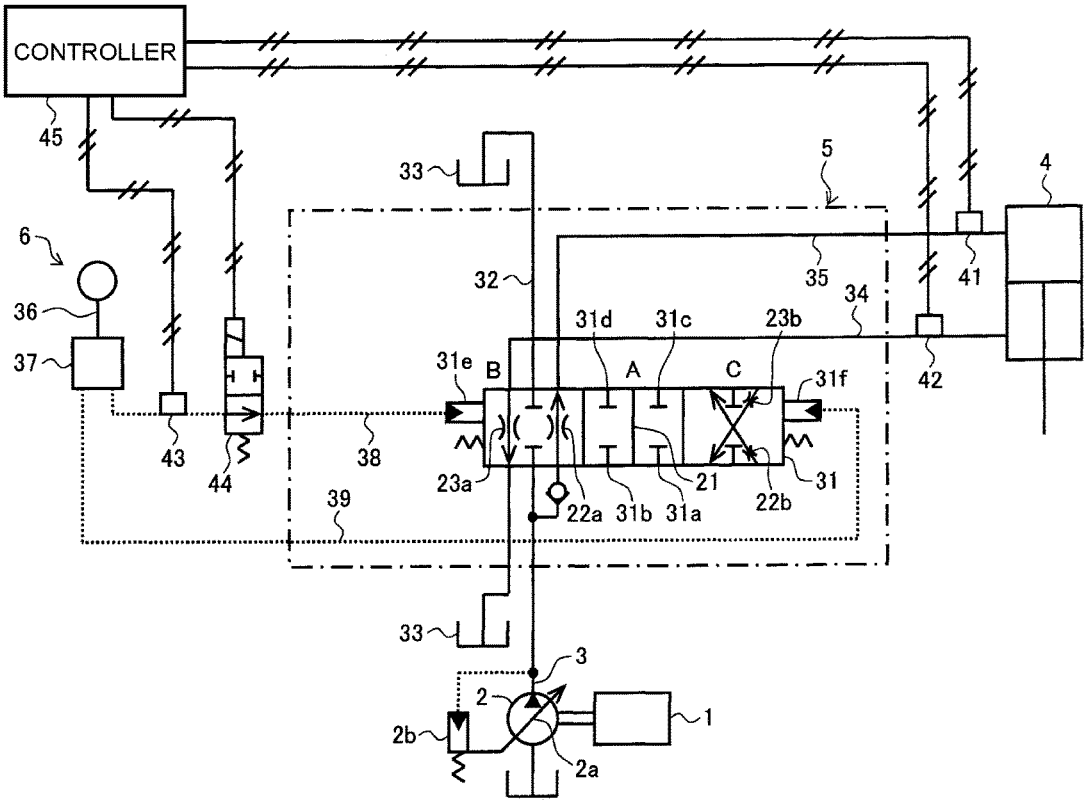
FIG. 2 is a schematic diagram showing a part of a hydraulic circuit for controlling an arm cylinder, of a hydraulic control system according to a first embodiment of the present invention.

FIG. 2 is a schematic diagram showing a part of a hydraulic circuit for controlling the arm cylinder 4, of a hydraulic control system according to a first embodiment of the present invention. As shown in FIG. 2, the hydraulic control system according to the present embodiment includes: a prime mover (e.g., an engine or an electric motor) 1; a hydraulic pump 2 driven by the prime mover 1; a valve device 5 having a flow control valve (control valve) 31 for the arm 312, which is connected to a delivery line (delivery flow passage) 3 of the hydraulic pump 2, for controlling the supply and discharge of hydraulic fluid (the flow rate and direction of hydraulic fluid) to and from the arm cylinder 4 according to the position of the spool; and the operation lever 6 serving as the operation device for the arm 312, for controlling the position of the spool of the flow control valve 31 according to the operation amount and the operation direction.

The hydraulic pump 2, which is of the variable displacement type, has a displacement volume varying member, such as a swash plate 2*a*, that is controlled by a horsepower control actuator 2*b* such that the volume of the hydraulic pump 2 is reduced as the delivery pressure of the hydraulic pump 2 is increased.

The flow control valve 31 is of the center bypass type that, when in a neutral position A, causes the delivery flow rate of the pump to flow into a tank 33 through a center bypass line 32, and has a center bypass section 21 positioned on the center bypass line 32. The center bypass line 32 has an upstream end connected to a delivery line 3 of the hydraulic pump 2 and a downstream end connected to the tank 33. The flow control valve 31 has a pump port 31*a*, a tank port 31*b*, and actuator ports 31*c*, 31*d*. The pump port 31*a* is connected to the center bypass line 32, the tank port 31*b* is connected to the tank 33, and the actuator ports 31*c*, 31*d* are connected respectively to the bottom and rod sides of the arm cylinder 4 through actuator lines 34, 35.

The operation lever 6 has a lever section 36 and a pilot pressure generating section 37 with a pair of pressure reducing valves incorporated therein. The pilot pressure generating section 37 is connected to pilot pressure bearing sections 31*e*, 31*f* of the flow control valve 31 through respective pilot lines 38, 39. When the operator in the cabin 305 operates the lever section 36, the pilot pressure generating section 37 actuates one of the pressure reducing valves according to the operation direction of the lever section 36, and outputs a pilot pressure according to the operation amount of the lever section 36 to one of the pilot lines 38, 39.

The flow control valve 31 has the neutral position A, a switched position B, and a switched position C to which its spool can be selectively shifted. When the operator performs an arm crowding operation through the operation lever 6, applying a pilot pressure through a pilot line 38 to the left pilot pressure bearing section 31*e*, the flow control valve 31 is shifted to the switched position B as shown in FIG. 2. At this time, the actuator line 35 serves as a flow passage on the meter-in side (meter-in flow passage) and the actuator line 34 as a flow passage on the meter-out side (meter-out flow passage). Hydraulic fluid from the hydraulic pump 2 is supplied to the bottom side of the arm cylinder 4, extending the arm cylinder 4 to perform an arm crowding actuation. When the operator performs an arm dumping operation on the operation lever 6, applying a pilot pressure through a pilot line 39 to the right pilot pressure bearing section 31*f*, the flow control valve 31 is shifted to the right switched position C. At this time, the actuator line 34 serves as a meter-in flow passage and the actuator line 35 as a meter-out flow passage. Hydraulic fluid from the hydraulic pump 2 is supplied to the rod side of the arm cylinder 4, contracting the arm cylinder 4 to perform an arm dumping actuation.

The flow control valve 31 has meter-in restrictors 22*a*, 22*b* and meter-out restrictors 23*a*, 23*b* which function as variable restrictors whose opening area varies according to the spool position. For example, when the flow control valve 31 is in the switched position B, the meter-in restrictor 22*a* controls the flow rate of hydraulic fluid supplied to the arm cylinder 4, and the meter-out restrictor 23*a* controls the flow rate of hydraulic fluid returning from the arm cylinder 4. When the flow control valve 31 is in the switched position C, the meter-in restrictor 22*b* controls the flow rate of hydraulic fluid supplied to the arm cylinder 4, and the meter-out restrictor 23*b* controls the flow rate of hydraulic fluid returning from the arm cylinder 4.

Figure 3:
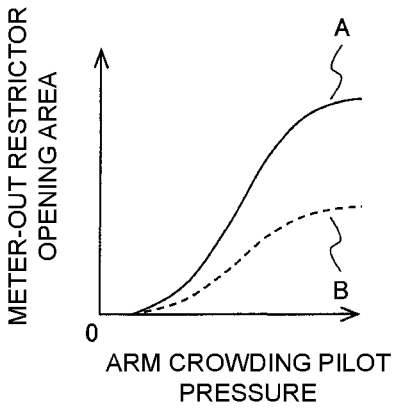
FIG. 3 is a diagram showing characteristics of a meter-out restrictor 23*a* according to the first embodiment of the present invention.

The metering characteristic of the meter-out restrictor 23*a* according to the present embodiment is shown in FIG. 3. In FIG. 3, the solid-line curve A represents the metering characteristic of the meter-out restrictor 23*a* at the time the arm crowding pilot pressure is applied to the flow control valve 31 according to the present embodiment. The broken-line curve B represents the metering characteristic of the meter-out restrictor 23*a* at the time the arm crowding pilot pressure is applied to a flow control valve 31 of a hydraulic control system according to a comparative example (see FIG. 5) to be described later. As described in detail later, in the hydraulic control system according to the comparative example, the relationship between the arm crowding pilot pressure and the opening area of the meter-out restrictor 23*a* is designed on the assumption that a heaviest attachment (at least heavier than a standard bucket) is mounted on the distal end of the arm.

The metering characteristic of the meter-out restrictor 23*a* according to the present embodiment, i.e., the relationship between the stroke and opening area of the flow control valve 31, is established such that, as indicated by the solid-line curve A, the opening area increases as the stroke (the arm crowding pilot pressure) of the operation lever 6 increases, and the opening area is greater than with the meter-out restrictor 23*a* according to the comparative example (the broken-line curve B) at the same arm crowding pilot pressure.

Referring back to FIG. 2, the hydraulic control system according to the present embodiment has, as its characteristic arrangement, a pressure sensor 41 attached to the actuator line 35 for detecting the pressure on the bottom side of the arm cylinder 4, a pressure sensor 42 attached to the actuator line 34 for detecting the pressure on the rod side of the arm cylinder 4, a pressure sensor 43 attached to the pilot line 38 for detecting the arm crowding pilot pressure (i.e., the operation amount of the operation lever 6 at the time of an arm crowding operation) output from the operation lever 6, a solenoid proportional valve 44 provided on the pilot line 38 for controlling the pilot pressure output to the pilot pressure bearing section 31*e* of the flow control valve 31 according to a command current value, and a controller (control device) 45 for being supplied with detected signals from the pressure sensor 41, the pressure sensor 42, and the pressure sensor 43, performing a predetermined processing sequence, and outputting a command current to the solenoid proportional valve 44.

Figure 4:
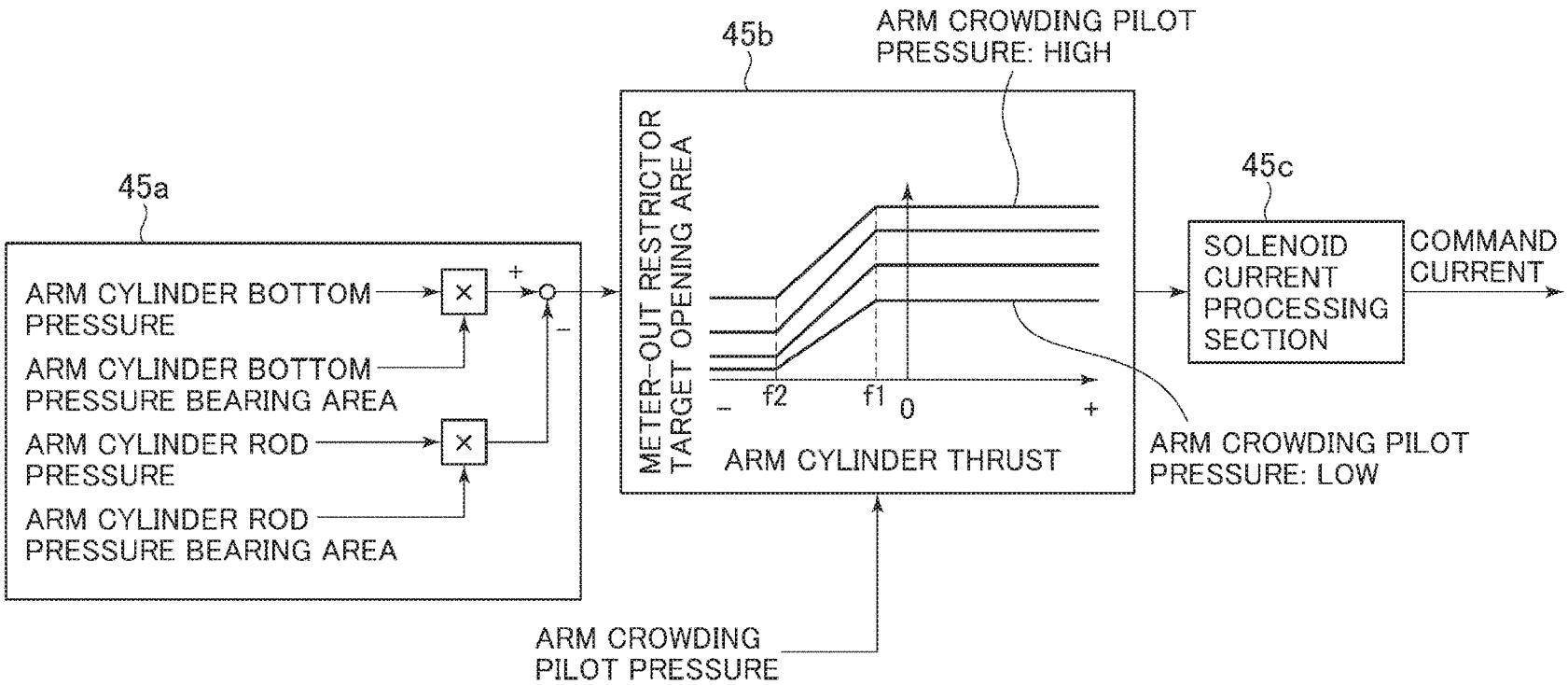
FIG. 4 is a functional block diagram of processing functions of a controller 45 according to the first embodiment of the present invention.

Processing functions of the controller 45 are illustrated in a functional block diagram shown in FIG. 4. The controller 45 has an arm cylinder thrust processing section 45*a*, a meter-out opening processing section 45*b*, and a solenoid current processing section 45*c*.

The arm cylinder thrust processing section 45*a* is supplied with an arm cylinder bottom pressure from the pressure sensor 41 and an arm cylinder rod pressure from the pressure sensor 42, and calculates a thrust for the arm cylinder 4 on the basis of the supplied pressures and bottom and rod pressure bearing areas, which are given as prescribed values, of the arm cylinder 4. Specifically, the arm cylinder thrust processing section 45*a* subtracts the product of the pressure and pressure bearing area on the rod side of the arm cylinder 4 from the product of the pressure and pressure bearing area on the bottom side of the arm cylinder 4, thereby calculating a thrust for the arm cylinder 4. The thrust for the arm cylinder 4 which has been calculated by the arm cylinder thrust processing section 45*a* is output to the meter-out opening processing section 45*b*. The arm cylinder thrust processing section 45*a* uses the pressure sensor 41 and the pressure sensor 42 as load sensors for detecting the magnitudes of loads acting on the arm cylinder 4.

The meter-out opening processing section 45*b* calculates a target opening area for the meter-out restrictor 23*a* according to the thrust of the arm cylinder 4 which has been calculated by the arm cylinder thrust processing section 45*a* and the arm crowding pilot pressure from the pressure sensor 43, using a table shown in FIG. 4.

The solenoid current processing section 45*c* calculates a solenoid current value according to the target opening area for the meter-out restrictor 23*a* which has been calculated by the meter-out opening processing section 45*b*, and outputs a current command having the calculated solenoid current value as a control signal to the solenoid proportional valve 44.

The arm cylinder thrust processing section 45*a* calculates a load based on an external force that is applied to the arm cylinder 4 when the arm cylinder 4 is extended (for arm crowding), as the thrust of the arm cylinder 4. When a load (positive load) in the direction opposite the direction in which the arm cylinder 4 is extended is applied to the arm cylinder 4 as a load based on an external force that is applied to the arm cylinder 4 for arm crowding, the arm cylinder thrust processing section 45*a* calculates a thrust of the arm cylinder 4 as a positive value. A positive load applied for arm crowding may be, for example, a force that an object such as the ground dug in an excavation work or the like applies to the arm cylinder 4 through the attachment 314 and the arm 312. On the other hand, when a load (negative load) in the same direction as the direction in which the arm cylinder 4 is extended is applied to the arm cylinder 4 as a load based on an external force that is applied to the arm cylinder 4 for arm crowding, the arm cylinder thrust processing section 45*a* calculates a thrust of the arm cylinder 4 as a negative value. A negative load applied for arm crowding may be, for example, a load (weight load) that the weight of the arm 312 and the attachment 314, etc. supported by the arm cylinder 4 applies to the arm cylinder 4.

As indicated by the table shown in FIG. 4, when the thrust of the arm cylinder 4 is of a positive value, the meter-out opening processing section 45*b* keeps the target opening area for the meter-out restrictor 23*a* at a constant value set for each value of the arm crowding pilot pressure, irrespectively of the magnitude of the thrust. When the thrust of the arm cylinder 4 is of a negative value, the meter-out opening processing section 45*b* monotonously reduces the target opening area for the meter-out restrictor 23*a* from a predetermined value (f1) as the magnitude of the thrust increases from zero, and sets the target opening area for the meter-out restrictor 23*a* to a constant value set for each value of the arm crowding pilot pressure when the magnitude of the thrust further increases and reaches another predetermined value (f2).

Therefore, given that the arm crowding pilot pressure is constant, the target opening area for the meter-out restrictor 23*a* is set such that it (1) takes an upper limit value when the thrust of the arm cylinder 4 is of a positive value, zero, and a negative value less than f1, (2) gradually decreases as the magnitude of the thrust of the arm cylinder 4 increases when the thrust of the arm cylinder 4 is of a negative value in the range from f1 to f2, and (3) takes a lower limit value when the thrust of the arm cylinder 4 exceeds f2.

As indicated by the table shown in FIG. 4, the target opening area for the meter-out restrictor 23*a* which is set for each operation amount of the operation lever 6 (arm crowding pilot pressure) has upper and lower limit values that are set so as to be reduced as the arm crowding pilot pressure decreases. In other words, the upper and lower limit values are set to increase as the operation amount of the operation lever 6 increases. The maximum values of the upper and lower limit values correspond to the metering characteristic indicated by the solid-line curve A in FIG. 3, and the minimum values of the upper and lower limit values correspond to the metering characteristic indicated by the broken-line curve B in FIG. 3.

In the example shown in FIG. 4, the range of the arm cylinder thrust in which the target opening area for the meter-out restrictor 23*a* varies is from f1 to f2, and this is a matter common to all values of the arm crowding pilot pressure. However, since this common matter is not indispensable to the present invention, the range of the arm cylinder thrust in which the target opening area for the meter-out restrictor 23*a* varies may be changed for each value of the arm crowding pilot pressure.

Figure 5:
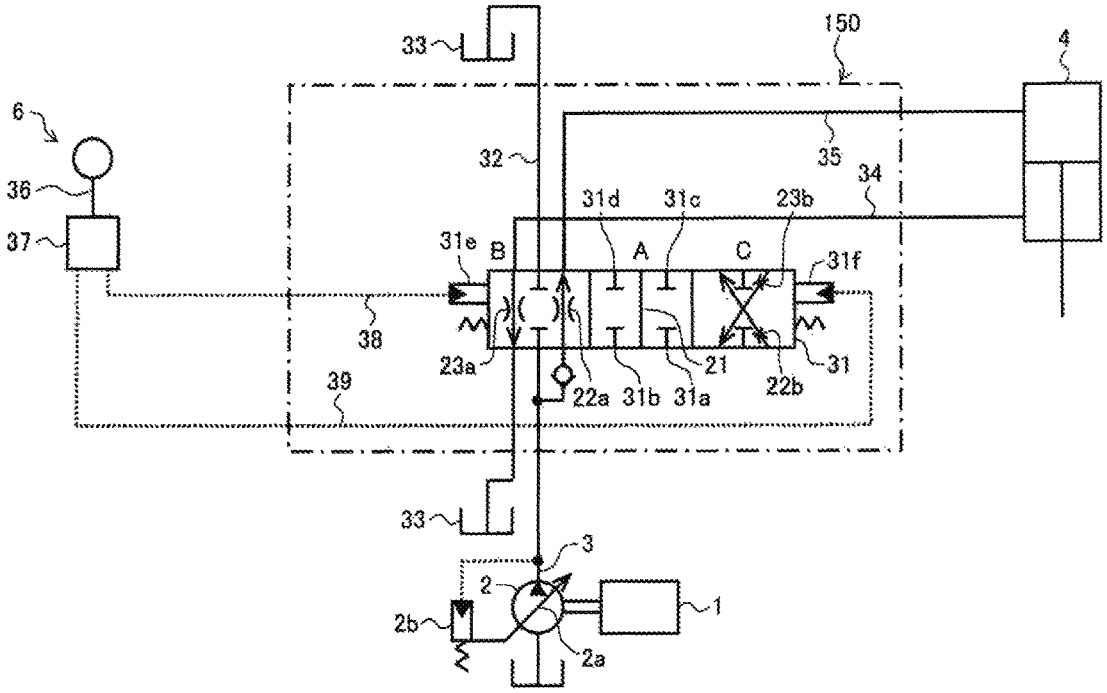
FIG. 5 is a schematic diagram showing a part of a hydraulic circuit for controlling an arm cylinder, of a hydraulic control system according to a comparative example of the present invention.

The actuation of the hydraulic excavator according to the present embodiment will be described below in comparison with a comparative example. FIG. 5 is a schematic diagram showing a part of a hydraulic circuit for controlling an arm cylinder, of a hydraulic control system according to a comparative example of the present invention. Parts that are common to the comparative example shown in FIG. 5 and the present embodiment shown in FIG. 2 are denoted by identical reference characters below, and their description will be omitted. Compared with the hydraulic control system according to the present embodiment shown in FIG. 2, the hydraulic control system according to the comparative example is free of the pressure sensor 41, the pressure sensor 42, the pressure sensor 43, the solenoid proportional valve 44, and the controller 45, and has the relationship (metering characteristic) between the arm crowding pilot pressure and the target opening area for the meter-out restrictor 23*a*, designed on the assumption that a heaviest attachment (at least heavier than a standard bucket) is mounted on the distal end of the arm 312. In other words, the hydraulic control system according to the comparative example is arranged such that the target opening area for the meter-out restrictor 23*a* does not vary according to changes in the arm cylinder thrust.

In the hydraulic control system according to the comparative example shown in FIG. 5, it is assumed that the flow control valve 31 for the arm is shifted to the position B shown in FIG. 5 for crowding the arm 312 above the ground, i.e., aerially. At this time, the flow control valve 31 controls the discharge of hydraulic fluid returning from the arm cylinder 4 with the meter-out restrictor 23*a* in the flow control valve 31, thereby controlling the speed at which the arm cylinder 4 is extended and preventing a breathing phenomenon (cavitation) from occurring due to a free fall of the arm 312. Specifically, the opening area of the meter-out restrictor 23*a* is restricted to restrict the flow passage on the meter-out side, developing a pressure buildup on the rod side of the arm cylinder 4 to generate a force required to resist the weight load of the arm 312 and the attachment 314. According to the comparative example, since the opening area of the meter-out restrictor 23*a* is set on the basis of the weight of the attachment heavier than the standard bucket, used as standards, the attachment that is mounted on the arm 312 does not increase the speed of the arm cylinder 4 and does not develop a breathing phenomenon.

However, when the standard bucket, instead of the heavy attachment used as design standards, is mounted in the comparative example, inasmuch as the pressure on the rod side of the arm cylinder 4 is higher than the weight load of the arm 312 and the standard bucket, the pressure on the bottom side has to be increased by supplying hydraulic fluid from the hydraulic pump 2 to the bottom side of the arm cylinder 4 in order to make the magnitude of the thrust of the arm cylinder 4 commensurate with the load. This causes an energy loss.

In contrast with the above comparative example, the hydraulic excavator according to the present embodiment is actuated as follows: With the hydraulic excavator according to the present embodiment, as shown in FIG. 4, the arm cylinder thrust processing section 45*a* detects a negative load that acts on the arm cylinder 4 and calculates the magnitude of the negative load. The meter-out opening processing section 45*b* and the solenoid current processing section 45*c* perform a control process for reducing the opening area of the meter-out restrictor 23*a* according to an increase in the calculated magnitude of the negative load. Consequently, even when the attachment 314 is replaced with an attachment having a different weight, it is possible to select an optimum opening area for the meter-out restrictor 23*a* according to the weight of the replacing attachment 314. According to the present embodiment, therefore, even when the weight of the object (mainly an attachment) supported by the arm cylinder 4 is changed, the meter-out loss is reduced according to a change in the magnitude of the negative load which the supported object applies to the arm cylinder 4.

According to the present embodiment, furthermore, there is employed an arrangement for changing the relationship between the cylinder thrust and the opening area of the meter-out restrictor 23*a* according to the operation amount of the operation lever 6, using the detected signal from the pilot pressure sensor 43 in addition to those from the bottom-side pressure sensor 41 and the rod-side pressure sensor 42 (corresponding to changing the control range for the opening area in 45*b* in FIG. 4). This limits the maximum value of the pressure kept in the rod-side hydraulic chamber, with the result that the pump delivery pressure is prevented from excessively rising for a reduced energy loss.

According to the present embodiment, it is also possible to select an optimum opening area for the meter-out restrictor 23*a* according to not only a change in the weight of the object supported by the arm cylinder 4, including the attachment 314, but also a change in the angle of the arm 312 (arm angle) as described below.

Figure 6:
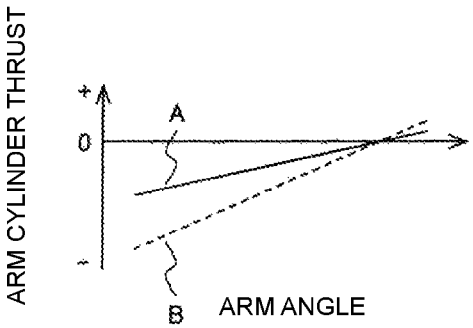
FIG. 6 is a diagram showing the relationship between the angle of an arm and the thrust of an arm cylinder at the time the arm is crowded aerially from a nearly horizontal angle to a vertical angle.

The relationship between the angle of the arm 312 and the thrust of the arm cylinder 4 at the time the arm 312 is crowded aerially from a nearly horizontal angle to a vertical angle is shown in FIG. 6. It is assumed here that the angle of the arm 312 with respect to the horizontal plane in the state where it is held substantially horizontally in the air by the arm cylinder 4 is zero, and the arm angle increases when the arm cylinder 4 is extended to rotate the arm 312 counterclockwise in FIG. 1 from this state. Therefore, when the arm angle is 90 degrees, the arm 312 is held vertically to the horizontal plane.

In FIG. 6, the solid-line curve A represents the load applied when the standard bucket is mounted on the arm 312, in terms of the thrust of the arm cylinder 4, and the broken-line curve B represents the load applied when an attachment heavier than the standard bucket is mounted on the arm, in terms of the thrust of the arm cylinder 4. In either case, when the arm angle is close to zero, the thrust is of a negative value because of the weight load of the arm 312 and the attachment 314. As the arm is then crowded with the arm angle increasing toward 90 degrees (vertical), the magnitude of the arm cylinder thrust decreases, and the arm cylinder thrust changes to a positive value in the vicinity of the vertical.

As described above, when the arm angle changes, the arm cylinder thrust also changes. According to the present embodiment in which the meter-out opening processing section 45*b* calculates a target opening area for the meter-out restrictor 23*a* using the arm cylinder thrust with the table shown in FIG. 4, the target opening area for the meter-out restrictor 23*a* can also be changed according to the arm angle. The relationship between the arm angle and the target opening area for the meter-out restrictor 23*a* is shown in FIG. 7.

Figure 7:
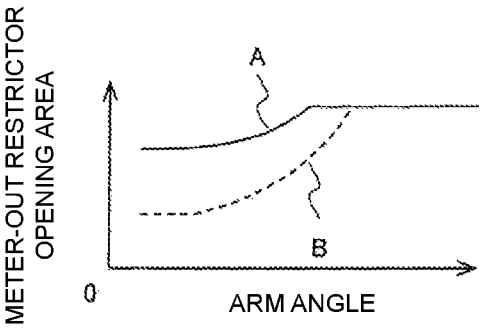
FIG. 7 is a diagram showing the relationship between the angle of the arm and the target opening area of the meter-out restrictor 23*a*.

In FIG. 7, the solid-line curve A represents the target opening area for the meter-out restrictor 23*a* at the time the standard bucket is mounted, and the broken-line curve B represents the target opening area for the meter-out restrictor 23*a* at the time an attachment heavier than the standard bucket is mounted on the arm 312. As shown in FIG. 7, according to the present embodiment, the opening area of the meter-out restrictor 23*a* can be controlled optimally with respect to the magnitude of the negative load on the arm cylinder 4 that varies according to the arm angle.

In FIG. 7, in case the standard bucket is mounted on the arm (the solid-line curve A), the target opening area is reduced when the arm angle is nearly zero, but increases up to a maximum value as the arm angle approaches the vertical. The maximum value corresponds to the metering characteristic indicated by the solid-line curve A in FIG. 3. In case the heavier attachment is mounted on the arm (the broken-line curve B), the target opening area is of a minimum value when the arm angle is nearly zero, but increases up to a maximum value as the arm angle approaches the vertical. The minimum value corresponds to the metering characteristic indicated by the solid-line curve B in FIG. 3.

According to the comparative example, the opening area of the meter-out restrictor 23*a* remains constant even when the arm angle changes. According to the present embodiment, since the opening area of the meter-out restrictor 23*a* is reduced according to an increase in the magnitude of the weight load (negative load) of the arm 312 and the attachment 314, the meter-out pressure loss is smaller than with the comparative example, resulting in a reduction in the energy loss.

According to the present embodiment, moreover, there is employed an arrangement for changing the relationship between the cylinder thrust and the opening area of the meter-out restrictor 23*a* according to the operation amount of the operation lever 6 (the magnitude of the pilot pressure for arm crowding), using the detected signal from the pilot pressure sensor 43 in addition to those from the bottom-side pressure sensor 41 and the rod-side pressure sensor 42. This limits the maximum value of the pressure kept in the rod-side hydraulic chamber, with the result that the pump delivery pressure is prevented from excessively rising for a reduced energy loss, according to the operation amount of the operation lever 6.

According the present embodiment, as described above, even when the weight and attitude of the object supported by the arm cylinder 4 (e.g., the attachment 314, the arm 312) is changed, since the opening area of the meter-out restrictor 23*a* is controlled at an optimum value for preventing a breathing phenomenon from being developed in the arm crowding operation, according to the magnitude of the negative load which the supported object applies to the arm cylinder 4, the meter-out loss is reduced even when the magnitude of the negative load is changed. According the present embodiment, furthermore, the hydraulic control system can be realized as a simple arrangement which is not excessively larger in size than the conventional makeup.

Figure 8:
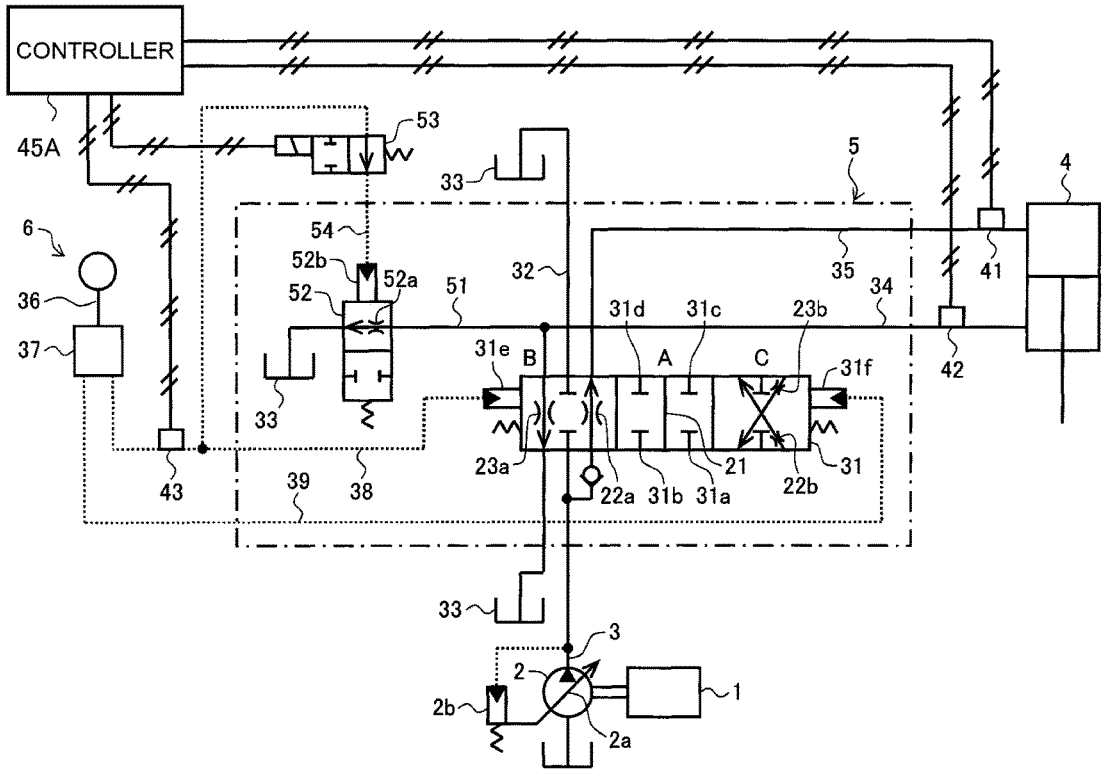
FIG. 8 is a schematic diagram showing a part of a hydraulic circuit for controlling an arm cylinder 4, of a hydraulic control system according to a second embodiment of the present invention.

A second embodiment of the present invention will be described below. Those parts of the second embodiment which are common to those shown in the previous figures are denoted by identical reference characters, and their description may be omitted. FIG. 8 is a schematic diagram showing a part of a hydraulic circuit for controlling an arm cylinder 4, of a hydraulic control system according to the second embodiment of the present invention. The hydraulic control system shown in FIG. 8 has a meter-out control valve 52, a solenoid proportional valve 53 for shifting the position of the spool of the meter-out control valve 52, and a controller 45A.

The meter-out control valve 52 is provided on a meter-out branch line 51. The meter-out branch line 51 is a flow passage branched from a middle of the actuator line 34 which serves as a meter-out flow passage for arm crowding, and is led to the tank 33. The meter-out branch line 51 is branched from the actuator line 34 at a branch point that is positioned between the arm cylinder 4 and the flow control valve 31.

The meter-out control valve 52 includes a 2-port 2-position valve and has a meter-out restrictor 52*a* and a pressure bearing section 52*b*. The pressure bearing section 52*b* is connected to a signal pressure line 54 branched from the pilot line 38 for outputting an arm crowding command. The solenoid proportional valve 53 is provided on the signal pressure line 54. The solenoid proportional valve 53 depressurizes an arm crowding pilot pressure supplied through the pilot line 38 according to the spool position determined by a command current output from the controller 45A, and outputs the depressurized arm crowding pilot pressure as a signal pressure for the control valve 52 to the pressure bearing section 52*b*.

According to the first embodiment, the meter-out loss is reduced by controlling the opening area of only the meter-out restrictor 23*a* in the flow control valve 31 according to the magnitude of the negative load. According to a main feature of the present embodiment, the meter-out loss is reduced by controlling the sum of the opening area of the meter-out restrictor 23*a* in the flow control valve 31 and the opening area of the meter-out restrictor 52*a* in the meter-out control valve 52 according to the magnitude of the negative load. According to the present embodiment, the sum of the opening areas of the two restrictors 23*a*, 52*a* is controlled by changing the opening area of the meter-out restrictor 52*a* according to the magnitude of the negative load.

Figure 9:
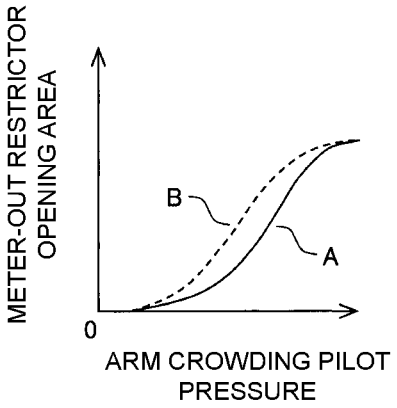
FIG. 9 is a diagram showing the relationship between the stroke and opening area of a meter-out control valve 52 and a flow control valve 31 according to the second embodiment of the present invention.

The metering characteristics of the meter-out restrictor 52*a* and the meter-out restrictor 23*a* according to the present embodiment, i.e., the relationship between the strokes (spool positions) and opening areas of the meter-out control valve 52 and the flow control valve 31, are shown in FIG. 9. In FIG. 9, the solid-line curve A represents the metering characteristic of the meter-out restrictor 52*a* at the time the arm crowding pilot pressure is applied to the meter-out control valve 52, and the broken-line curve B represents the metering characteristic of the meter-out restrictor 23*a* at the time the arm crowding pilot pressure is applied to the flow control valve 31.

According to the present embodiment, the metering characteristic of the arm cylinder 4 for arm crowding is determined on the basis of the sum of target opening areas for the two restrictors 52*a*, 23*a*. For example, the metering characteristic of the arm cylinder 4 may be set such that the sum of the target opening areas for the two restrictors 52*a*, 23*a* is in agreement with or close to the metering characteristic indicated by the solid-line curve A in FIG. 3. In this case, the metering characteristic according to the present embodiment is the same as the metering characteristic according to the first embodiment.

According to the present embodiment, the target opening area for the meter-out restrictor 52*a* (the solid-line curve A) is changed according to the magnitude of the negative load acting on the arm cylinder 4 (the magnitude of the arm cylinder thrust) (see a table with respect to the meter-out opening processing section 45*d*, to be described later, shown in FIG. 10), and the target opening area for the meter-out restrictor 23*a* (the broken-line curve B) is set not to change according to the magnitude of the negative load.

The characteristics of the opening areas of the two restrictors 52*a*, 23*a* described here are by way of example only, and are not particularly limited insofar as the sum of the opening areas of the two restrictors 52*a*, 23*a* is set to change according to the magnitude of the negative load as is the case with the first embodiment. In the example shown in FIG. 9, the opening areas are set such that the solid-line curve A is positioned below the broken-line curve B. However, the metering characteristics represented by the broken-line curve B and the solid-line curve A may be the same as each other, or the solid-line curve A may be set to be positioned above the broken-line curve B.

The controller 45A is supplied with detected signals from the pressure sensor 41, the pressure sensor 42, and the pressure sensor 43, performs a predetermined processing sequence based on the detected signals to calculate a solenoid current value, and outputting a command current having the solenoid current value to the solenoid proportional valve 53.

Figure 10:
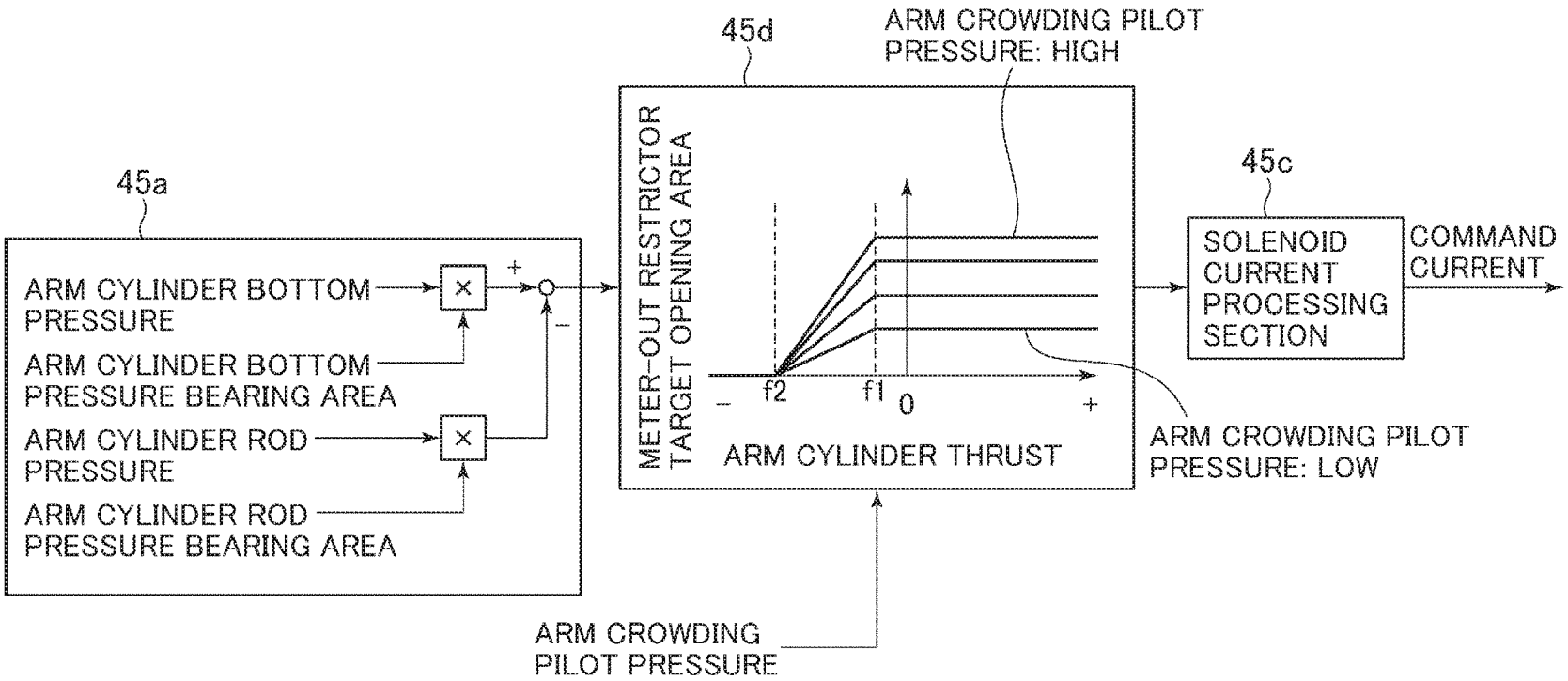
FIG. 10 is a functional block diagram of processing functions of a controller 45A according to the second embodiment of the present invention.

FIG. 10 is a functional block diagram of processing functions of the controller 45A according to the present embodiment. The controller 45A according to the present embodiment is different from the controller 45 according to the first embodiment in that it has a meter-out opening processing section 45*d*. The meter-out opening processing section 45*d* calculates a target opening area for the meter-out restrictor 52*a* according to the thrust of the arm cylinder 4 and the arm crowding pilot pressure, using a table shown in FIG. 10.

As indicated by the table shown in FIG. 10, when the thrust of the arm cylinder 4 is of a positive value, the meter-out opening processing section 45*d* keeps the target opening area for the meter-out restrictor 52*a* at a constant value set for each value of the arm crowding pilot pressure, irrespectively of the magnitude of the thrust. When the thrust of the arm cylinder 4 is of a negative value, the meter-out opening processor 45*d* monotonously reduces the target opening area for the meter-out restrictor 52*a* from a predetermined value (f1) as the magnitude of the thrust increases from zero, and sets the target opening area for the meter-out restrictor 52*a* to zero when the magnitude of the thrust further increases and reaches another predetermined value (f2).

Therefore, given that the arm crowding pilot pressure is constant, the target opening area for the meter-out restrictor 52*a* is set such that it (1) takes an upper limit value when the thrust of the arm cylinder 4 is of a positive value, zero, and a negative value less than f1, (2) gradually decreases as the magnitude of the thrust of the arm cylinder 4 increases when the thrust of the arm cylinder 4 is of a negative value in the range from f1 to f2, and (3) takes zero (lower limit value) when the thrust of the arm cylinder 4 exceeds f2.

As indicated by the table shown in FIG. 10, the target opening area for the meter-out restrictor 52*a* which is set for each operation amount of the operation lever 6 (arm crowding pilot pressure) has an upper limit value (when the arm cylinder thrust is negative and less than f1, zero, and positive) that is set so as to be reduced as the arm crowding pilot pressure decreases. In other words, the upper limit value is set to increase as the operation amount of the operation lever 6 increases.

The actuation of the present embodiment will be described below. With the hydraulic excavator arranged as described above according to the present embodiment, as shown in FIG. 10, the arm cylinder thrust processing section 45*a* detects a negative load that acts on the arm cylinder 4 and calculates the magnitude of the negative load. The meter-out opening processing section 45*d* and the solenoid current processing section 45*c* perform a control process for reducing the opening area of the meter-out restrictor 52*a* according to an increase in the calculated magnitude of the negative load. Consequently, as is the case with the first embodiment, the sum of the opening areas of the two restrictors 52*a*, 23*a* is controlled so as to be reduced according to an increase in the magnitude of the negative load (if the metering characteristics for arm crowding are set such that the sum of the target opening areas for the two restrictors 52*a*, 23*a* is in agreement with the metering characteristic indicated by the solid-line curve A in FIG. 3, then the hydraulic control system according to the present embodiment functions in the same manner as the hydraulic control system according to the first embodiment). Even when the weight of the object (mainly an attachment 314) supported by the arm cylinder 4 is changed, since the opening areas of the two restrictors 52*a*, 23*a* are selected as having values optimum for the magnitude of the negative load (weight load) at the time, the meter-out loss is reduced according to a change in the magnitude of the negative load which the supported object applies to the arm cylinder 4.

According to the present embodiment, furthermore, the sum of the opening area of the meter-out restrictor 52*a* and the opening area of the meter-out restrictor 23*a* can be controlled not only at an optimum value for a change in the weight of the object supported by the arm cylinder 4, but also at an optimum value according to a change in the arm angle.

Figure 11:
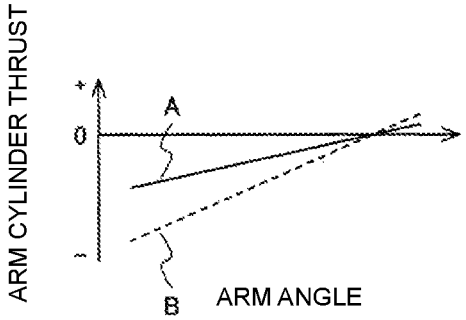
FIG. 11 is a diagram showing the relationship between the arm angle and the thrust of an arm cylinder 4 at the time the arm 312 is crowded aerially from a nearly horizontal angle to a vertical angle.

The relationship between the angle of the arm 312 and the thrust of the arm cylinder 4 at the time the arm 312 is crowded aerially from a nearly horizontal angle to a vertical angle is shown in FIG. 11. In FIG. 11, the solid-line curve A represents the load applied when the standard bucket is mounted on the arm, in terms of the thrust of the arm cylinder 4, and the broken-line curve B represents the load applied when an attachment heavier than the standard bucket is mounted on the arm, in terms of the thrust of the arm cylinder 4. In either case, when the arm angle is close to zero, the arm cylinder thrust is of a negative value because of the weight load of the arm 312 and the attachment 314. As the arm angle approaches the vertical, the arm cylinder thrust decreases and is of a positive value in the vicinity of the vertical.

Figure 12:
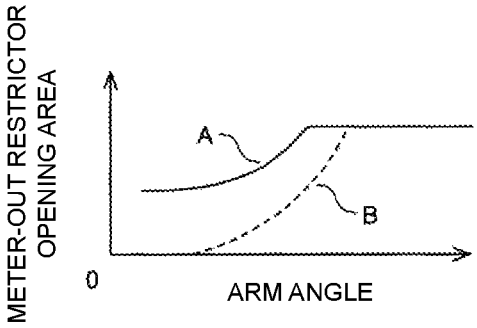
FIG. 12 is a diagram showing the relationship between the angle of the arm and the target opening area of a meter-out restrictor 52*a*.

As is the case with the first embodiment, the relationship between the arm angle and the target opening area for the meter-out restrictor 52*a* at this time is shown in FIG. 12. In FIG. 12, the solid-line curve A represents the target opening area for the meter-out restrictor 52*a* at the time the standard bucket is mounted on the arm, and the broken-line curve B represents the target opening area for the meter-out restrictor 52*a* at the time an attachment heavier than the standard bucket is mounted on the arm. In case the standard bucket is mounted on the arm (the solid-line curve A), the target opening area is reduced when the arm angle is nearly zero, but increases up to a maximum value as the arm angle approaches the vertical. In case the heavier attachment is mounted on the arm (the broken-line curve B), the target opening area is of a minimum value (i.e., zero) when the arm angle is nearly zero, but increases up to a maximum value as the arm angle approaches the vertical.

According to the comparative example shown in FIG. 5, the opening area of the meter-out restrictor 23*a* remains constant even when the arm angle changes. According to the present embodiment, since the sum of the opening area of the meter-out restrictor 52*a* and the opening area of the meter-out restrictor 23*a* is reduced according to an increase in the magnitude of the weight load (negative load) of the arm 312 and the attachment 314, the meter-out pressure loss is smaller than with the comparative example, resulting in a reduction in the energy loss. As this actuation is carried out according to the arm crowding pilot pressure, an energy loss reducing effect according to the operation amount of the operation lever 6 is obtained.

According to the present embodiment, therefore, even when the weight and attitude of the object supported by the arm cylinder 4 (e.g., the attachment 314, the arm 312) is changed, since the sum of the opening area of the meter-out restrictor 52*a* and the opening area of the meter-out restrictor 23*a* is controlled at an optimum value for preventing a breathing phenomenon from being developed in the arm crowding operation, according to the magnitude of the negative load which the supported object applies to the arm cylinder 4, the meter-out loss is reduced even when the magnitude of the negative load is changed.

According to the present embodiment, in particular, the variable restrictors 23*a*, 52*a* are installed respectively in the two meter-out flow passages 34, 51, and the metering characteristic for arm crowding is determined on the basis of the sum of the opening areas of the two restrictors 52*a*, 23*a*. Therefore, the range in which the opening areas can be controlled is increased compared with the first embodiment in which the metering characteristic is determined on the basis of only the variable restrictor 23*a*. This feature offers a design merit for large-size construction machines which have a tendency for hydraulic actuators to produce high meter-out flow rates.

According to the present embodiment, the pilot pressure output from the operation lever 6 (which may be referred to as "secondary pressure" because it is generated by depressurizing the delivery pressure (primary pressure) of a pilot pump (not shown)) is used as the hydraulic fluid source of the pilot pressure for acting on the pressure bearing section 52*b* to change the spool position of the meter-out control valve 52. However, the primary pressure, instead of the secondary pressure, may be used. Specifically, the delivery pressure of the pilot pump may be used as the pilot pressure for the meter-out control valve 52. An embodiment incorporating such a modification will be described below as a third embodiment of the present invention with reference to FIG. 13.

Figure 13:
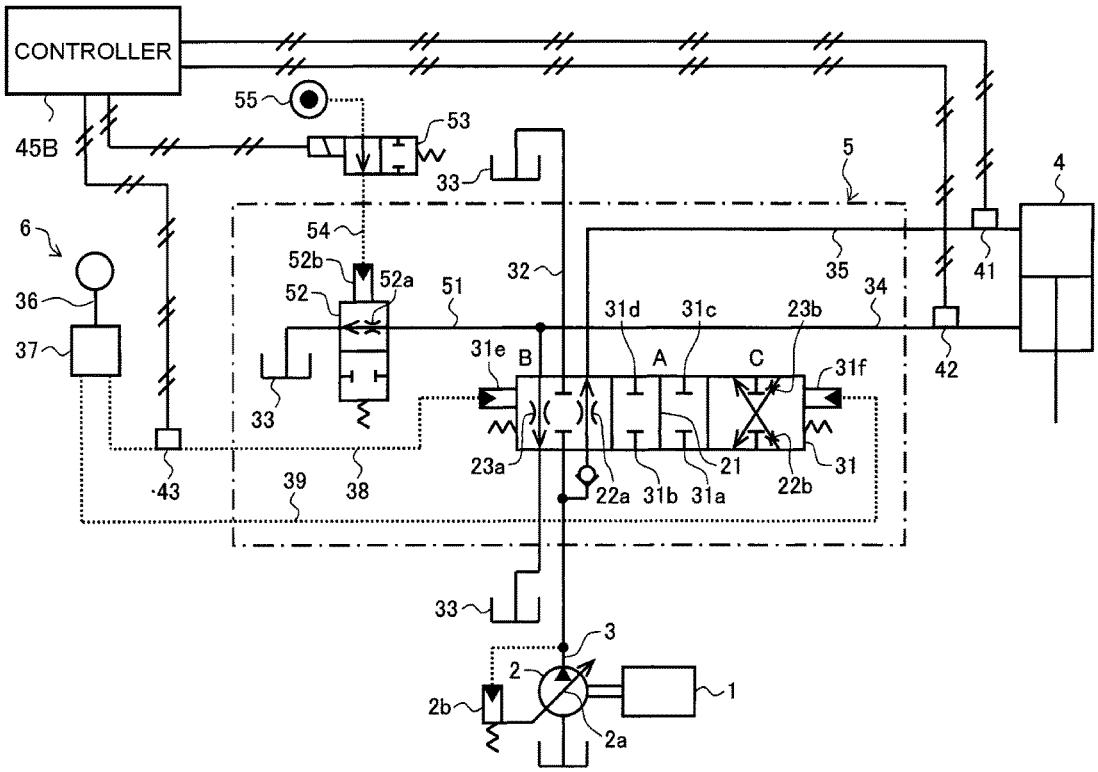
FIG. 13 is a schematic diagram showing a part of a hydraulic circuit for controlling an arm cylinder 4, of a hydraulic control system according to a third embodiment of the present invention.

FIG. 13 is a schematic diagram showing a part of a hydraulic circuit for controlling the arm cylinder 4, of a hydraulic control system according to the third embodiment of the present invention. In FIG. 13, the solenoid proportional valve 53 has a primary side which is not connected to the pilot line 38 for giving an arm crowding command as shown in FIG. 8. Instead, the primary side of the solenoid proportional valve 53 is connected to a pilot hydraulic fluid source 55 which is supplied with the delivery pressure from a pilot pump (not shown).

Though not described in detail to avoid repetitive description, a controller 45B according to the present embodiment controls the sum of the opening areas of the two restrictors 52*a*, 23*a* according to the magnitude of the arm cylinder thrust, as with the controller 45A according to the second embodiment.

According to the present embodiment, since the pilot hydraulic fluid source 55 is used as the source of the primary pressure for the solenoid proportional valve 53, the upper limit value for the pilot pressure for the meter-out control valve 52 can be made higher than with the second embodiment where the arm crowding pilot pressure is used as the primary pressure, for thereby widening the control range for the opening area of the meter-out restrictor 52*a*. This arrangement offers a large merit especially when the arm crowding pilot pressure is low.

In the second and third embodiments, only the opening area of one (the meter-out restrictor 52*a*) of the two variable restrictors 23*a*, 52*a* is changed according to the magnitude of the arm cylinder thrust. However, the opening areas of both the variable restrictors 23*a*, 52*a* may be changed according to the magnitude of the arm cylinder thrust insofar as the sum of the opening areas of both the variable restrictors 23*a*, 52*a* can be controlled such that it is reduced according to an increase in the negative load.

In the second and third embodiments, furthermore, the hydraulic control system arranged such that hydraulic fluid is discharged from the arm cylinder 4 to the tank through the two meter-out flow passages 34, 51 when the arm is crowded has been described. However, three or more meter-out flow passages may be used when the arm is crowded. In such a modification, at least one variable restrictor may be installed in each of the three or more meter-out flow passages, and the sum of the opening areas of the variable restrictors, at least one of which is installed in each of the three or more meter-out flow passages, may be changed according to the magnitude of the arm cylinder thrust, for thereby reducing the meter-out loss.

In each of the above embodiments, the present invention is applied to the valve device for the arm cylinder 4 of the hydraulic excavator for reducing the loss at the time the arm is crowded. However, since the same problem occurs when the bucket cylinder 315 is extended to crowd the bucket, the present invention may be also applied to the valve device for the bucket cylinder 315. For such an application, the arm cylinder 4 in the hydraulic circuit shown in FIG. 2, for example, may be replaced with the bucket cylinder 315, the flow control valve 31 for the arm may be replaced with a flow control valve for the bucket, and the operation lever 6 for the arm may be replaced with an operation lever for the bucket. As long as various weight loads act on hydraulic actuators, the present invention is also applicable to valve devices for actuators (e.g., the travel hydraulic motors 318 and the swing hydraulic motor 319) other than the arm cylinder 4 and the bucket cylinder 315 of the hydraulic excavator, or valve devices for actuators of construction machines (e.g., a wheel loader, a crane, etc.) other than the hydraulic excavator.

The present invention is not limited to the embodiments described above, but includes various changes and modifications in ranges not departing from the principles thereof. For example, the present invention is not limited to have all arrangements described in the above embodiments, but may include one in which some of the arrangements are omitted. Some of the arrangements described in certain embodiments may be added to or replaced with some of the arrangements described in other embodiments.

DESCRIPTION OF REFERENCE CHARACTERS

1: Prime mover
2: Hydraulic pump
2*a*: Displacement volume varying member (swash plate)
2*b*: Horsepower control actuator
3: Delivery line
4: Arm cylinder
5: Valve device
6: Operation lever
21: Center bypass section
22*a*, 22*b*: Meter-in restrictor
23*a*, 23*b*: Meter-out restrictor
31: Flow control valve
31*e*, 31*f*: Pressure bearing section
32: Center bypass line
33: Tank
34, 35: Actuator line
36: Lever section
37: Pilot pressure generating section
38, 39: Pilot line
41, 42, 43: Pressure sensor
44: Solenoid proportional valve
45: Controller
45*a*: Arm cylinder thrust processing section
45*b*: Meter-out opening processing section
45*c*: Solenoid current processing section
45*d*: Meter-out opening processing section
51: Branch line
52: Meter-out control valve
52*a*: Meter-out restrictor
52*b*: Pressure bearing section
53: Solenoid proportional valve
54: Signal pressure line
55: Pilot hydraulic fluid source
312: Arm
314: Bucket (attachment)
315: Bucket cylinder

The invention claimed is:

1. A construction machine, comprising:

a hydraulic actuator driven by hydraulic fluid delivered from a hydraulic pump;

a control valve configured to control supply and discharge of hydraulic fluid to and from the hydraulic actuator according to a position of a spool;

an operation device configured to control the position of the spool of the control valve according to an operation amount and an operation direction;

one or plurality of meter-out flow passages disposed to pass therethrough hydraulic fluid discharged from the hydraulic actuator;

at least one variable restrictor provided in the one meter-out flow passage, or at least one variable restrictor provided in each of the plurality of meter-out flow passages;

a load sensor configured to detect a magnitude of a negative load applied by an external force to the hydraulic actuator in a same direction as an actuation direction of the hydraulic actuator; and a control device configured to reduce, according to an increase in the magnitude of the negative load detected by the load sensor, an opening area of the one variable restrictor in a case where only one variable restrictor is provided, or a sum of the opening areas of the plurality of variable restrictors in a case where two or more variable restrictors are provided, wherein a range in which the opening area of the one variable restrictor or the sum of the opening areas of the plurality of variable restrictors is varied by the control device according to the increase in the magnitude of the negative load detected by the load sensor has an upper limit value and a lower limit value with respect to each value of the operation amount of the operation device, and wherein the upper limit value and the lower limit value are increased according to an increase in the operation amount of the operation device.

2. The construction machine according to claim 1, wherein:

the one meter-out flow passage is a first flow passage through which hydraulic fluid discharged from the hydraulic actuator flows when the hydraulic actuator is actuated in the same direction as the negative load, the first flow passage passing through the control valve, the at least one variable restrictor is a first variable restrictor provided in the control valve in the first flow passage, and the control device is configured to reduce the opening area of the first variable restrictor by changing the position of the spool of the control valve according to the increase in the magnitude of the negative load detected by the load sensor.

3. The construction machine according to claim 1, wherein:

the plurality of meter-out flow passages include:

a first flow passage through which hydraulic fluid discharged from the hydraulic actuator flows when the hydraulic actuator is actuated in the same direction as the negative load, the first flow passage passing through the control valve, and a second flow passage through which hydraulic fluid discharged from the hydraulic actuator flows when the hydraulic actuator is actuated in the same direction as the negative load, the second flow passage being branched from a middle of the first flow passage, the at least one variable restrictor provided in each of the plurality of meter-out flow passages includes:

a first variable restrictor provided in the control valve in the first flow passage and having an opening area that increases according to an increase in the operation amount of the operation device, and a second variable restricting device provided in the second flow passage and having an opening area that increases according to an increase in a pilot pressure output from a hydraulic fluid source, and the control device is configured to reduce the opening area of the second variable restrictor according to the increase in the magnitude of the negative load detected by the load sensor, and thereby reduces the sum of the opening areas of the first variable restrictor and the second variable restrictor according to the increase in the magnitude of the negative load detected by the load sensor.

4. The construction machine according to claim 3, wherein:

the hydraulic fluid source of the pilot pressure for the second variable restricting device is a pilot pump or the operation device that allows hydraulic fluid from the pilot pump to be depressurized and output.

* * * * *